US007040060B2

(12) United States Patent
Cox

(10) Patent No.: US 7,040,060 B2
(45) Date of Patent: May 9, 2006

(54) MOUNTING ELEMENTS, MOUNTING ARRANGEMENTS, AND METHODS FOR MOUNTING LINERS TO STRUCTURES IN POOLS AND SPAS

(75) Inventor: Wesley O. Cox, Johnstown, NY (US)

(73) Assignee: Saratoga Spa & Bath, Inc., Latham, NY (US)

( * ) Notice: Subject to any disclaimer, the term of this patent is extended or adjusted under 35 U.S.C. 154(b) by 82 days.

(21) Appl. No.: 10/350,824

(22) Filed: Jan. 23, 2003

(65) Prior Publication Data

US 2004/0144044 A1 Jul. 29, 2004

(51) Int. Cl.
*E02D 27/00* (2006.01)
*F16J 15/02* (2006.01)

(52) U.S. Cl. ..... 52/169.7; 52/182; 277/630; 277/637; 277/641

(58) Field of Classification Search ..... 52/182, 52/169.7, 741.4; 277/637, 641, 630
See application file for complete search history.

(56) References Cited

U.S. PATENT DOCUMENTS 3,755,981 A * 9/1973 West ..... 52/169.7 X
3,952,338 A 4/1976 Troxclair ..... 4/172.15
4,067,794 A * 1/1978 Ganzi et al. ..... 277/641 X
4,106,246 A * 8/1978 LaFountaine ..... 52/169.7
4,158,757 A * 6/1979 Reichert et al. ..... 277/637
4,170,126 A * 10/1979 Craven ..... 277/637 X
5,802,631 A * 9/1998 Friedman ..... 52/169.7 X
5,916,098 A 6/1999 Crelin ..... 52/169
5,916,099 A * 6/1999 Hall ..... 52/169.7
6,015,152 A * 1/2000 Swensen et al. ..... 277/630 X
6,045,140 A * 4/2000 Morris, Jr. ..... 277/630
6,381,768 B1 * 5/2002 Herman ..... 52/169.7 X
6,408,577 B1 * 6/2002 Desjoyaux et al. ..... 52/182
6,595,525 B1 * 7/2003 Schmidt ..... 277/630
6,761,360 B1 * 7/2004 Hammi ..... 277/630
6,769,697 B1 * 8/2004 Ishikawa et al. ..... 277/641 X
2002/0100230 A1 * 8/2002 Mazure ..... 52/169.7
2002/0135137 A1 * 9/2002 Hammi ..... 277/637
2004/0104539 A1 * 6/2004 Nakazawa ..... 277/637
2005/0046123 A1 * 3/2005 Minowa et al. ..... 277/630

* cited by examiner

*Primary Examiner*—Rodney B. White
(74) *Attorney, Agent, or Firm*—Heslin Rothenberg Farley & Mesiti P.C.; John Pietrangelo

(57) ABSTRACT

Improved mounting elements, mounting arrangements, and methods of mounting liners to structures, such as stair assemblies, in pools and spas are disclosed. One aspect is a mounting element for retaining at least a portion of a liner to a structure of a spa or pool, the mounting element including a face plate and a gasket mounted to the face plate. Another aspect is a mounting arrangement including a gasketed mounting element comprising a face plate and a gasket mounted to the face plate and means for mounting the gasketed mounting element to a structure wherein the liner is secured. Another aspect is a method of mounting a liner to a structure of a pool or spa. The invention facilitates the assembly of pools and spas by reducing the number of individual parts required and minimizing the potential for damaging the liner compared to prior art arrangements and methods.

20 Claims, 5 Drawing Sheets

MOUNTING ELEMENTS, MOUNTING ARRANGEMENTS, AND METHODS FOR MOUNTING LINERS TO STRUCTURES IN POOLS AND SPAS

FIELD OF THE INVENTION

This invention relates, generally, to methods and devices for mounting liners to structures, for example stair assemblies, in pools and spas, and, more particularly, to mounting elements, mounting arrangements, and methods of mounting liners using a one-piece, gasketed face plate.

BACKGROUND AND SUMMARY OF THE INVENTION

Pools and spas are often fabricated with water impermeable barriers, or "liners", to retain water. Pool liners or spa liners are typically made from a pliable plastic or polymeric material that retains water but also provides a smooth, flexible surface that enhances the bathing experience, for example, compared to a concrete surface. However, when structures such as steps, ladders, or seats are incorporated into the pool or spa, the interface between the surface of the typically rigid structure and the typically flexible liner must minimize or prevent leakage while providing an esthetically pleasing appearance and avoiding sharp projections or extensions that can provide a potential source of injury to the bather. Typically, the pool or spa manufacturer also desires that the interface between the liner and the structure be easily assembled with minimum effort and the assembly process be readily repeatable. The present invention provides assembly mounting elements, mounting arrangements, and mounting methods that facilitate the fabrication and assembly of pool or spa structures which interface with liners.

One aspect of the invention is a mounting element for retaining at least a portion of a liner to a structure of a spa or pool, the mounting element having a face plate and a gasket mounted to the face plate. In one aspect of the invention, the mounting element is fabricated by co-extruding the face plate and the gasket. In another aspect of the invention, the mounting element further comprises a cover piece that mounts over the face plate. In another aspect of the invention, the structure comprises one of a step assembly, a ladder assembly, and a seat assembly.

Another aspect of the invention is a mounting arrangement for retaining at least a portion of a liner to a structure of a spa or pool, the mounting arrangement including a gasketed mounting element comprising a face plate and a gasket mounted to the face plate; and means for mounting the gasketed mounting element to the structure wherein the liner is secured to the structure. In one aspect of this invention, the gasketed mounting element is fabricated by co-extruding the face plate and the gasket. In another aspect of the invention, the means for mounting includes a backing member positioned behind the structure and means for attaching the gasketed mounting element to the backing member. In another aspect of the invention, the means for attaching the gasketed mounting element to the backing member comprises at least one mechanical fastener. In another aspect of the invention, the mounting arrangement further comprises a cover which mounts to the gasketed mounting element. Again, the mounting arrangement may be used to mount a liner to a stair assembly, a ladder assembly, and a seat assembly, or any other structure installed in pools and spas.

Another aspect of the invention is a method of mounting a liner to a structure of a pool or spa, the structure having a first side and a second side and at least one through hole, the method including providing a gasketed mounting element comprising a face plate and a gasket mounted to the face plate; providing a backing member; positioning the backing member adjacent the second side of the structure; positioning the liner adjacent the first side of the structure; positioning the mounting element adjacent the liner on the first side of the structure wherein the gasket contacts the liner; and securing the mounting element to the backing member wherein the liner is secured to the structure. In one aspect of the invention, the gasketed mounting element is fabricated by co-extruding the face plate and the gasket. In another aspect of the invention, the structure of the pool or spa is a stair assembly, a ladder assembly, a seat assembly, or any other structure installed in pools and spas. In another aspect of the invention, providing a gasketed mounting element comprises providing a gasketed mounting element having at least one through hole for accepting at least one mechanical fastener, and providing a backing member comprises providing a backing member having at least one hole for accepting a mechanical fastener, and wherein securing the mounting element to the backing plate comprises securing the mounting element to the backing plate by means of at least one mechanical fastener. In another aspect of the invention, the liner comprises at least one through hole, and wherein positioning the liner adjacent the first side of the structure further comprises aligning the at least one through hole of the liner with the at least one through hole of the structure.

Thus, aspects of the present invention provide improved mounting elements, mounting arrangements, and methods of mounting liners to structures, such as stair assemblies, in pools and spas. The present invention facilitates the assembly of pools and spas by reducing the number of individual parts required and minimizing the potential for damaging the liner compared to prior art arrangements and methods while maintaining the desired function, that is, providing a liquid-tight interface.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF FIGURES

Figure 1:
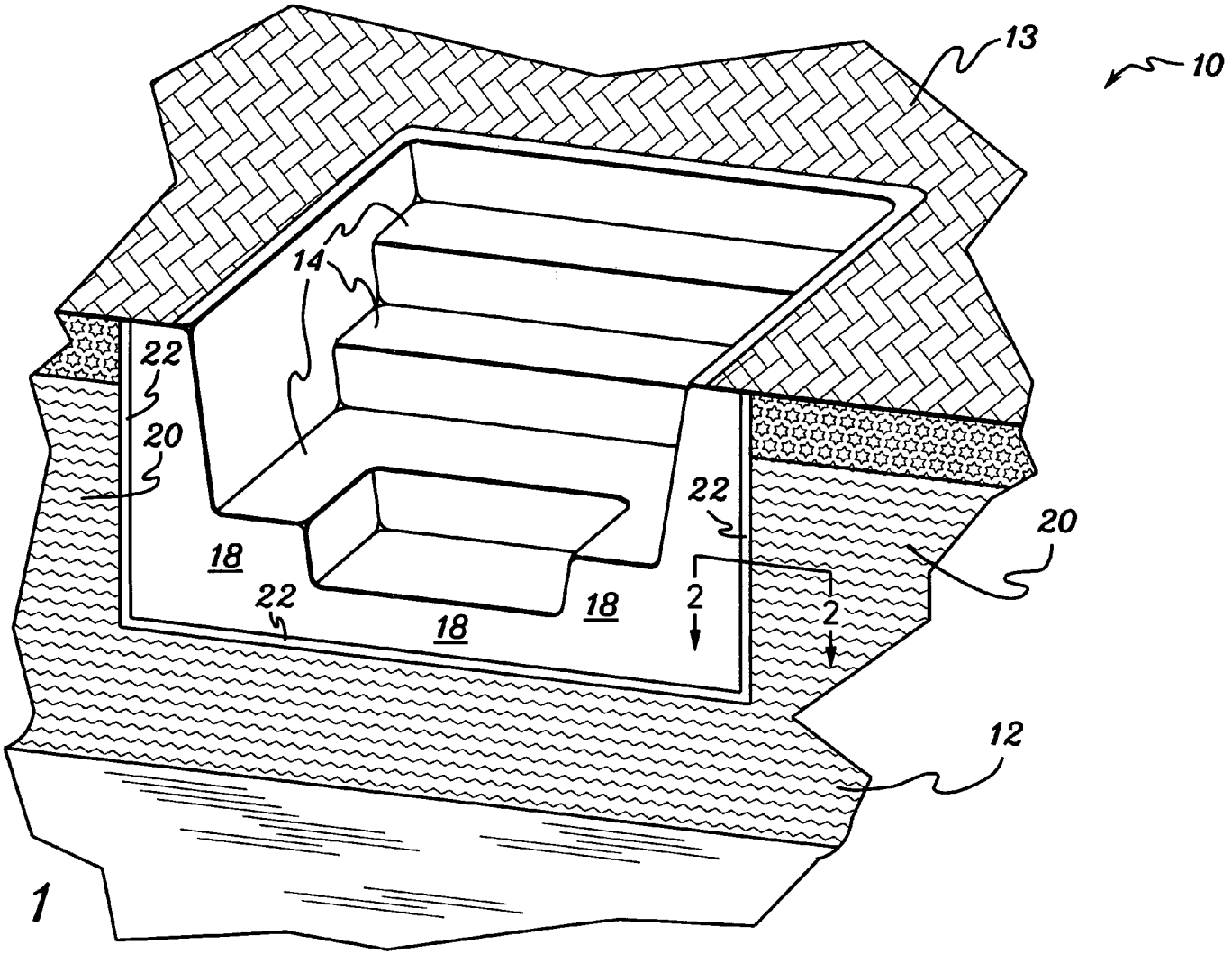
FIG. 1 is a perspective view of a stair assembly for a pool or spa according to one aspect of the present invention.

The details and scope of aspects of the present invention can best be understood upon review of the attached figures and their following descriptions. FIG. 1 illustrates a perspective view of a stair assembly 10 for a pool or spa 12 according to one aspect of the present invention. As is typical in the art, stair assembly 10 may be adapted to conform to the surface of a patio or deck 13 while providing access to a pool or spa 12, of which only a partial view is shown in FIG. 1. Stair assembly 10 typically includes one or more steps or landings 14, but in one aspect of the invention, stair assembly 10 comprises one or more seats (not shown) instead of steps or landings 14. Stair assembly 10 also typically includes flanges 18 which provide a mounting surface for stair assembly 10 and conform the surface of the stair assembly to the pool or spa 12 into which stair assembly 10 is installed. As shown in FIG. 1, flanges 18 may be extend horizontally or vertically. Stair assembly 10 is typically supported by some form of support structure (not shown), for example, an appropriate structure fabricated from structural steel angles and pipes.

As is common in conventional pool or spa construction, pool or spa 12 may typically include a liner 20, that is, a liquid impermeable barrier that retains the water in the pool or spa. Liner 20 may also comprise a flexible material that provides a pliable surface when contacted by a bather and provides a more comfortable bathing experience. Liner 20 may typically be made from a vinyl-type plastic, for example, polyvinyl chloride (PVC)-type plastic, or similar materials. Liner 20 is typically supported by some form of support structure (not shown) for example, a concrete wall or fabricated wood or steel structure.

The interface between liner 20 and stair assembly 10 is often critical to the successful installation of a stair or related assembly into a pool or spa. The interface between the liner 20 and stair assembly 10 typically must be smooth and unobtrusive and provide little or no projections or edges that can be susceptible to contact with the bather to prevent damage to the interface and prevent harm to the bather. The interface between liner 20 and stair assembly 10 must typically also provide a water-tight seal to prevent leakage of water. One aspect of the invention provides such an interface while also providing an interface that facilitates assembly of the pool or spa.

Figure 2:
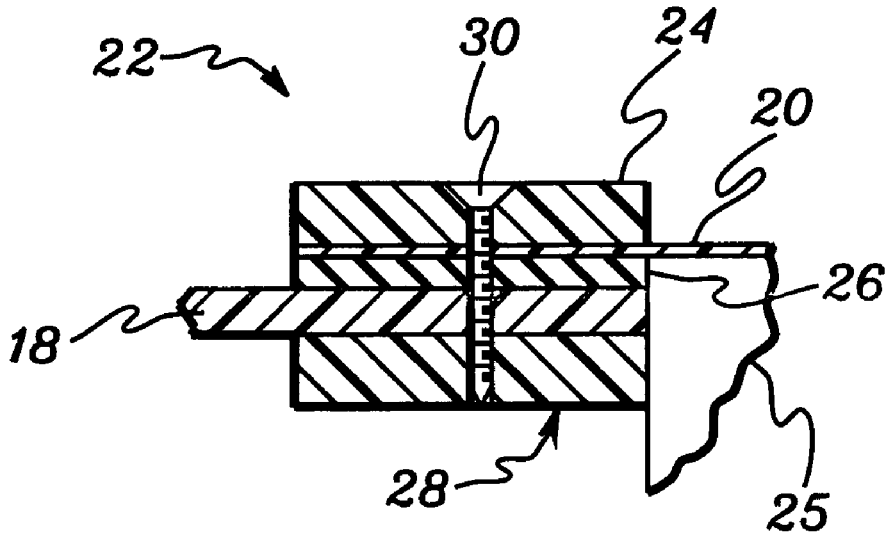
FIG. 2 illustrates a cross-sectional view of a prior art mounting element over which the presenting invention is an improvement as viewed along lines 2—2 of FIG. 1.

According to one aspect of the invention, the interface between stair assembly 10 and liner 20 comprises a mounting arrangement 22. As shown in FIG. 1, mounting arrangement 22 typically extends along flanges 18 and provides an interface between flanges 18 and liner 20. FIG. 2 illustrates a cross-section of a typical prior art mounting arrangement 22 taken along the lines 2—2 shown in FIG. 1. As shown in FIG. 2, prior art mounting arrangement 22 includes a face plate 24, a gasket 26, and a backing plate 28 which are mounted to flange 18 and retain liner 20. A representative section of the structure 25 which supports liner 20 is shown in FIG. 2. As shown in FIG. 2, in a typical prior art arrangement, liner 20 is sandwiched between face plate 24 and gasket 26 which are mounted to stair assembly flange 18 by means of one or more fasteners 30 attached to backing plate 28. Fasteners 30 are typically threaded fasteners, or screws, which pass through holes in liner 20, gasket 26, and flange 18 and threadably engage holes in backing plate 28. Typically, fasteners 30 are counter-sunk in face plate 24 to provide a smooth unobstructed surface to face plate 24. Though not shown in FIG. 2, prior art mounting arrangement 22 may also include a cover that conceals face plate 24 and fasteners 30.

Figure 3:
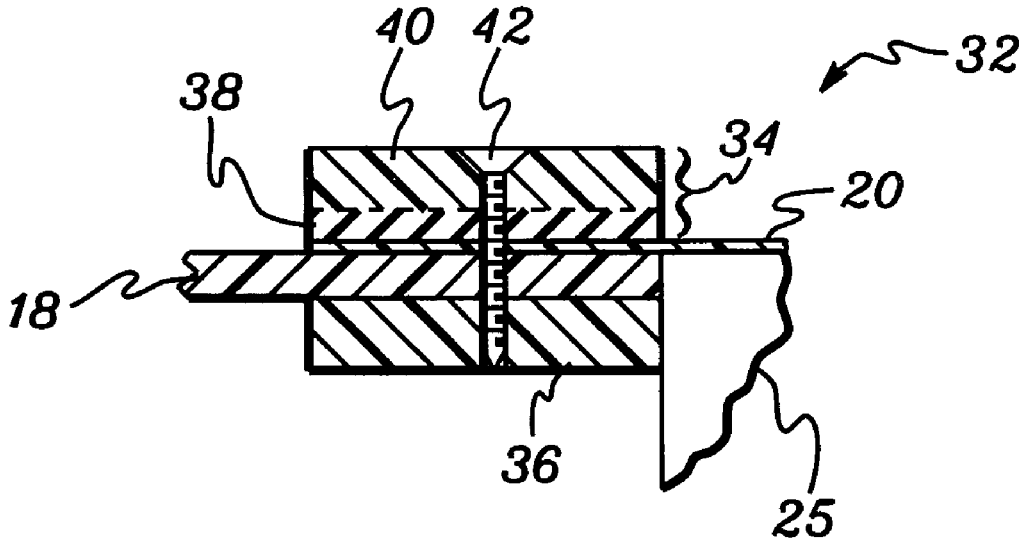
FIG. 3 illustrates a cross-sectional view similar to the view shown in FIG. 2 of one mounting arrangement according to one aspect of the present invention.

FIG. 3 illustrates a cross-sectional view similar to the view shown in FIG. 2 and illustrates mounting arrangement 32 according to one aspect of the present invention. As shown in FIG. 3, according to this aspect of the invention, mounting arrangement 32 includes face plate or mounting element 34 and backing plate 36 which retain liner 20 on flange 18. However, according to this aspect of the invention, face plate 34 comprises a one-piece construction having a gasket 38 mounted to a top plate 40, for example, gasket 38 may be rigidly mounted to top plate 40. Gasket 38 may be mounted to top plate 40 by any conventional means, for example, by means of mechanical fasteners or adhesives, and the like. In one aspect of the invention, face plate 34 may be fabricated wherein top plate 40 and a gasket 38 are fabricated as a single component, for example, simultaneously. In one aspect of the invention, face plate 34 may be fabricated by extruding top plate 40 and gasket 38, that is, top plate 40 and a gasket 38 may be co-extruded, for example, from the same extrusion die.

In a fashion similar to the prior art construction shown in FIG. 2, face plate 34 having gasket 38 may be mounted to flange 18 to retain liner 20 by means of one or more fasteners 42, for example, one or more threaded fasteners. In one aspect of the invention, face plate 34 having gasket 38 is mounted to flange 18 by one or more threaded fasteners threaded into holes in backing plate 36. Holes for fasteners 42 in face plate 34, liner 20, flange 18, and backing plate 36 may be predrilled prior to assembly or drilled at the time of assembly. In one aspect of the invention, an adhesive may be applied between the flange 18 and backing plate 36, for example, a methyl methacrylate-type adhesive, for instance, a Plexus MA 300-series adhesive, manufactured by ITW Plexus of Danvers, Mass., though a similar adhesive may be used. In one aspect of the invention, Plexus MA 300 adhesive is applied between flange 18 and backing plate 36. According to this aspect of the invention, the compression of gasket 38 against liner 20 and flange 18 provides a liquid tight seal between face plate 34 and flange 18. Again, though not shown in FIG. 3, mounting element 32 may also include a cover that conceals face plate 34 and fasteners 42.

One of the advantages of the invention shown in FIG. 3 compared to the prior art arrangement shown in FIG. 2 is the reduction in the number of parts required to mount liner 20 onto flange 18. The present invention also facilitates the mounting of liner 20 to flange 18 by eliminating the need to align the face plate 24, liner 20, and gasket 26, as is required by the prior art arrangement shown in FIG. 2. In the arrangement of the present invention shown in FIG. 3, no loose gaskets need to be handled, for example, no loose gaskets need to be aligned with a separate face plate 24 and liner 20. Another advantage of the aspect of the invention shown in FIG. 3 compared to the prior art arrangement shown in FIG. 2 is that the liner 20 in the invention of FIG. 3 is not exposed to the rigid, possibly sharp, edges of face plate 24 shown in FIG. 2. According to the prior art, the relatively rigid edges of face plate 24 provide an undesirable surface upon which the relatively softer liner 20 may puncture or tear and generally require extra care during assembly. The flexible surface of gasket 38 of the present invention minimizes the potential for puncturing or tearing liner 20 and thus facilitates the assembly of liner 20 to flange 18.

Figure 4:
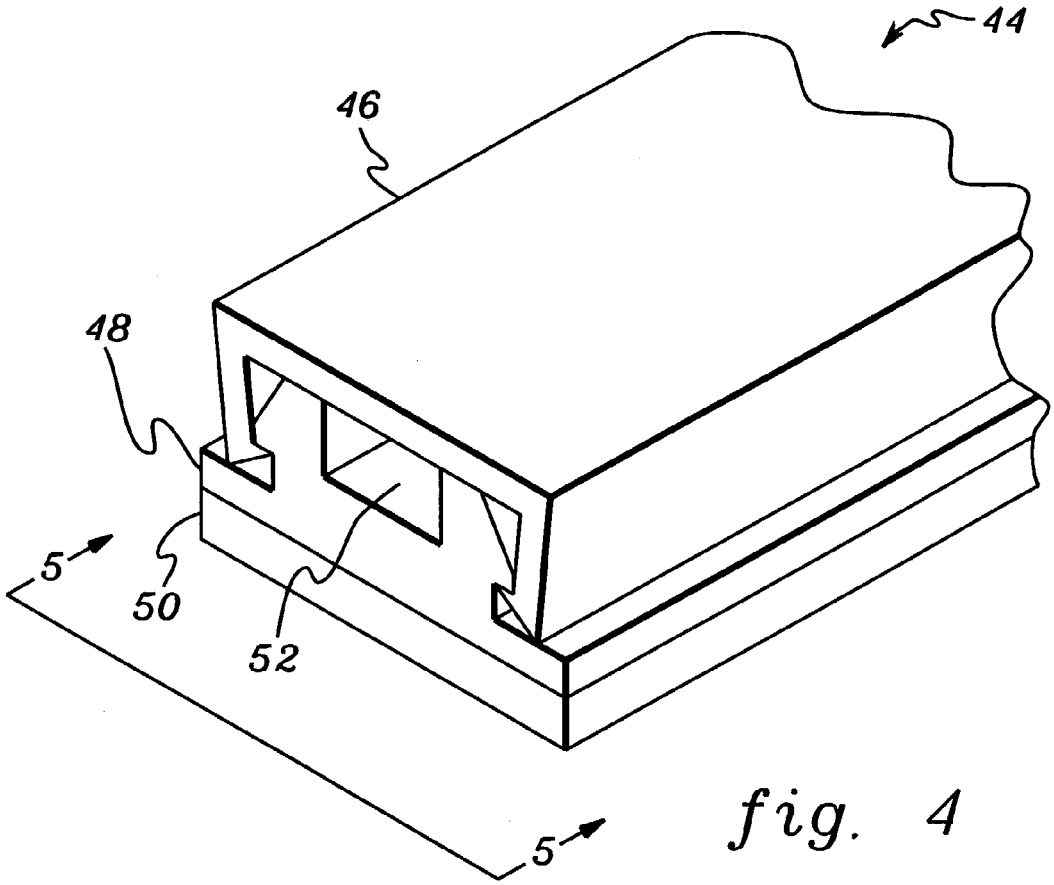
FIG. 4 illustrates a perspective view of a mounting element according to one aspect of the present invention.
Figure 5:
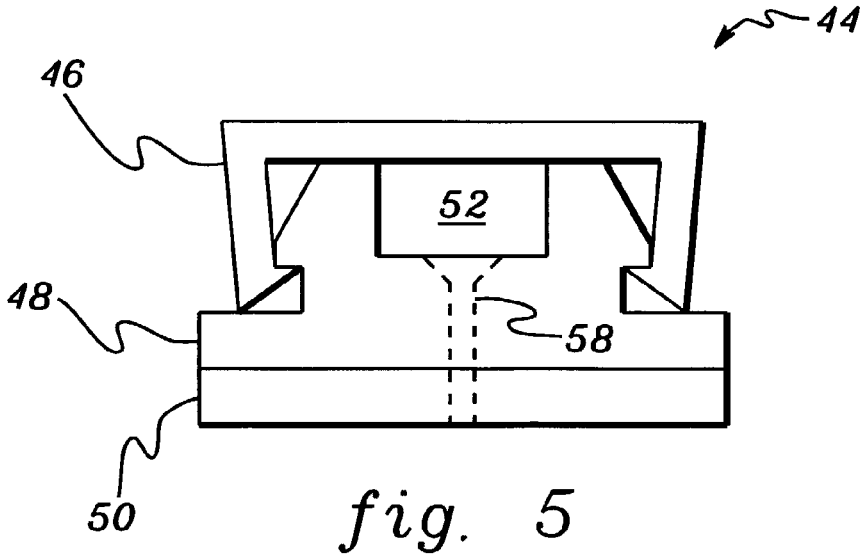
FIG. 5 illustrates an axial view of the aspect of the invention shown in FIG. 4 as viewed along lines 5—5 of FIG. 4.
Figure 6:
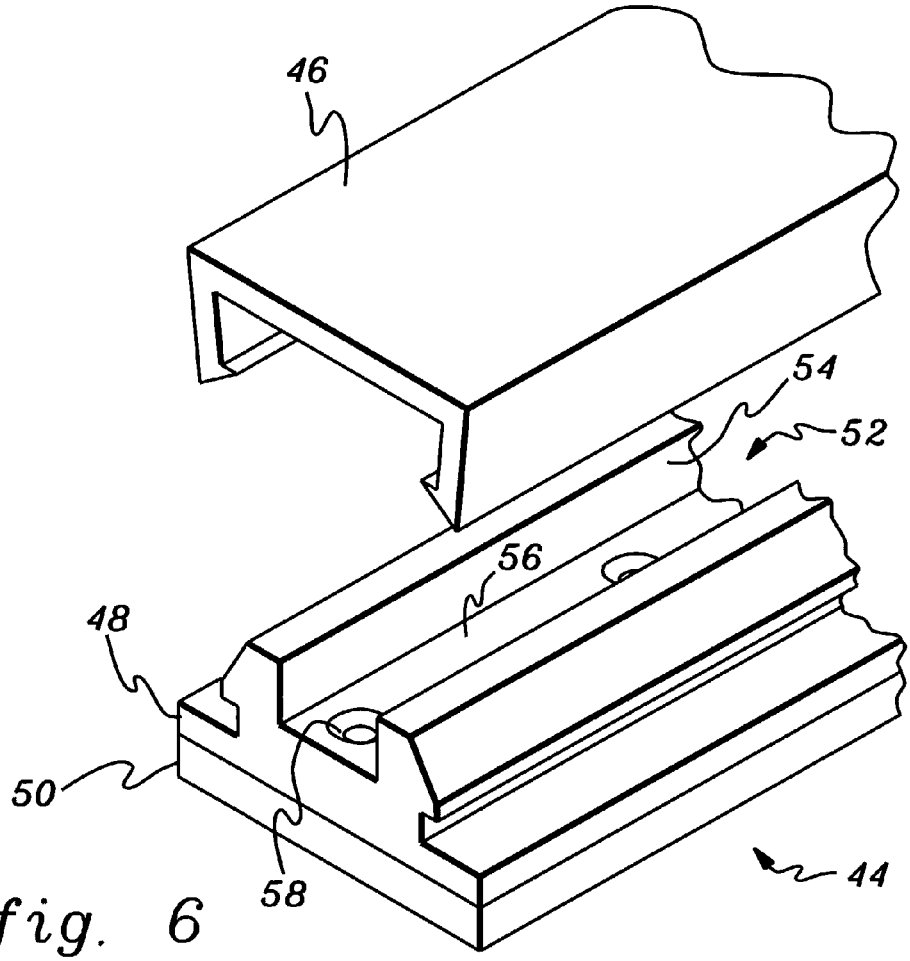
FIG. 6 illustrates an exploded perspective view of the aspect of the invention shown in FIG. 4.
Figure 7:
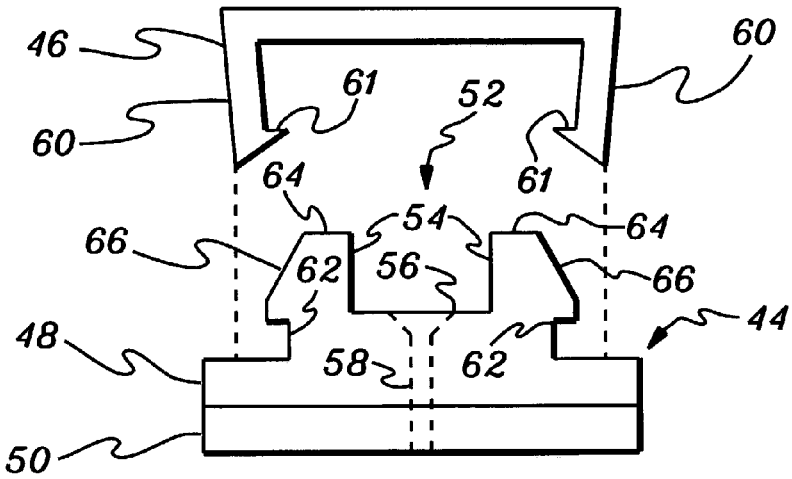
FIG. 7 illustrates an exploded view of the axial view of the aspect of the invention shown in FIG. 5.

FIG. 4 illustrates a perspective view of mounting element 44 according to another aspect of the present invention. Mounting element 44 may be provided with a cover 46. FIG. 5 illustrates an axial view of mounting element 44 as viewed along lines 5—5 shown in FIG. 4. FIG. 6 illustrates an exploded perspective view of mounting element 44 having cover 46 and FIG. 7 illustrates an exploded axial view of mounting element 44 and cover 46. As shown in FIGS. 4 through 7, mounting element 44 comprises a top plate 48 and a gasket 50. According to one aspect of the invention, gasket 50 is integrally mounted to top plate 48, for example, by means of fasteners or adhesives. In one aspect of the invention, top plate 48 and a gasket 50 are fabricated as a single component, for example, simultaneously. As discussed above, in one aspect of the invention, top plate 48 and gasket 50 are fabricated together by means of extrusion, that is, top plate 48 and a gasket 50 may be co-extruded, for example, from the same extrusion die.

According to one aspect of the invention, top plate 48 comprises a material that is more harder than gasket 50. For example, top plate 48 may comprise any type of plastic, specifically, any type of thermoplastic, for example, a vinyl-type plastic, an ABS-type plastic, a nylon-type plastic, a polystyrene, or a polypropylene, among others, or their equivalents. In one aspect of the invention, top plate 48 comprises a PVC-type plastic, or its equivalent. In one aspect of the invention, top plate 48 may be fabricated from a rigid material, for example, a material having a Izod impact resistance of at least about 0.50 ft-lb/in. In one aspect of the invention, top plate 48 may comprise a rigid material having an Izod impact resistance of at least about 5.0 ft-lb/in or at least about 10.0 ft-lb/in, or even greater. In one aspect of the invention, gasket 50 may be any type of plastic, specifically, any type of thermoplastic, for example, a vinyl-type plastic, an ABS-type plastic, a nylon-type plastic, a polystyrene, or a polypropylene, among others, or their equivalents. In one aspect of the invention, gasket 50 comprises a PVC-type plastic, or its equivalent. In one aspect of the invention, gasket 50 may comprise a flexible material, for example, a material more flexible than the material of top plate 48. In one aspect of the invention, gasket 50 may comprise a material having a Shore A hardness of between about 50 and about 100, for example, a material having a Shore A hardness of between about 60 and about 80. In one aspect of the invention, where top plate 48 and gasket 50 are co-extruded, top plate 48 may comprise a rigid PVC plastic having an Izod impact resistance of at least about 6.0 ft-lb/in and gasket 50 may comprise a flexible PVC plastic having a Shore A hardness of between about 50 and about 70.

According to one aspect of the invention, top plate 48 and gasket 50 may be fabricated by co-extrusion. For example, in this aspect of the invention, top plate 48 and gasket 50 may be fabricated substantially simultaneously by hot extrusion out of separate extrusion dies and then formed into a single component. For example, the extrusion die used for the fabrication of gasket 50 may be positioned adjacent, for instance above, the extrusion die for the fabrication of top plate 48. The material of top plate 48 and gasket 50 may be fed by separate extruders, for example, separate screw conveyors, that feed the separate dies. In this aspect of the invention, the dies have the shape of the desired cross sections of top plate 48 and gasket 50. In one aspect of the invention, the co-extrusion of top plate 48 and gasket 50 from adjacent extrusion dies is followed by mating surfaces of top plate 48 and gasket 50, for example while still hot, wherein the top plate 48 and gasket 50 fuse or bond to form of single component. The co-extruded top plate 48 and gasket 50 are then cooled and cut to length as desired.

In another aspect of the invention, top plate 48 and gasket 50 may be fabricated by dual durometer extrusion. In this aspect of the invention, both materials from which top plate 48 and gasket 50 are to be formed are introduced to the same die and the two streams of material merge into one extrusion made of two bonded profiles, for example, each profile having a different hardness or durometer.

In one aspect of the invention, when top plate 48 and gasket 50 are fabricated by co-extruding or dual durometer extrusion, top plate 48 and gasket 50 are made of materials that will readily bond together when mated while hot. For example, in one aspect of the invention, top plate 48 and gasket 50 are both made of PVC plastic. In one aspect of the invention, top plate 48 comprises a rigid PVC plastic having a Izod impact resistance of at least about 5.0 ft-lb/in and gasket 50 comprises a PVC plastic of Shore A durometer hardness less than about 100.

As shown in FIGS. 4 through 7, top plate 48 may comprise a channel 52. Channel 52 may have sidewalls 54 and a base 56, see FIG. 7. Channel 52 typically may include one or more mounting holes 58, for example, counter-sunk mounting holes, that pass through top plate 48 and gasket 50. Mounting holes 58 may be used to attach mounting element 44 to a backing plate, such as backing plate 36 shown in FIG. 3, for example, by means of mechanical fasteners, such as screws.

As shown in FIGS. 4 through 7, mounting element 44 may be provided with a cover 46. Cover 46 may be provided to conceal the fasteners retaining element 44 or to cover channel 52 to provide a smooth, unobtrusive mounting. Cover 46 may be mounted to mounting element 44 by conventional means, for example, mechanical fasteners or adhesives, and the like. In one aspect of the invention, element 44 is adapted to receive cover 46 without the use of fasteners or adhesives. As shown most clearly in FIG. 7, according to one aspect of the invention, mounting element 44 may be adapted to retain cover 46 by means of projections 61 on flexible sidewalls 60 of cover 46 which engage recesses 62 in mounting element 44. According to one aspect of the invention, sidewalls 54 of channel 52 comprise side rails 64 having beveled surfaces 66. As cover 46 is compressed upon mounting element 44, projections 61 on flexible sidewalls 60 contact beveled surfaces 66 on rails 64 whereby sidewalls 60 deflect outward. Upon further compression of cover 46 against mounting element 44, projections 61 engage, for example, "snap into", recesses 62 to retain cover 46 on mounting element 44. In one aspect of the invention, cover 46 may be removed from mounting element 44 by simply disengaging projections 61 from recesses 62 by outwardly deflecting sidewalls 60. In one aspect of the invention, cover 46 comprises a flexible material for example a plastic, specifically, any type of thermoplastic, for example, a vinyl-type plastic, an ABS-type plastic, a nylon-type plastic, a polystyrene, or a polypropylene, among others, or their equivalents. In one aspect of the invention, cover 46 is made of PVC plastic. Cover 46 may also comprise a metal, such as aluminum or steel.

Figure 8:
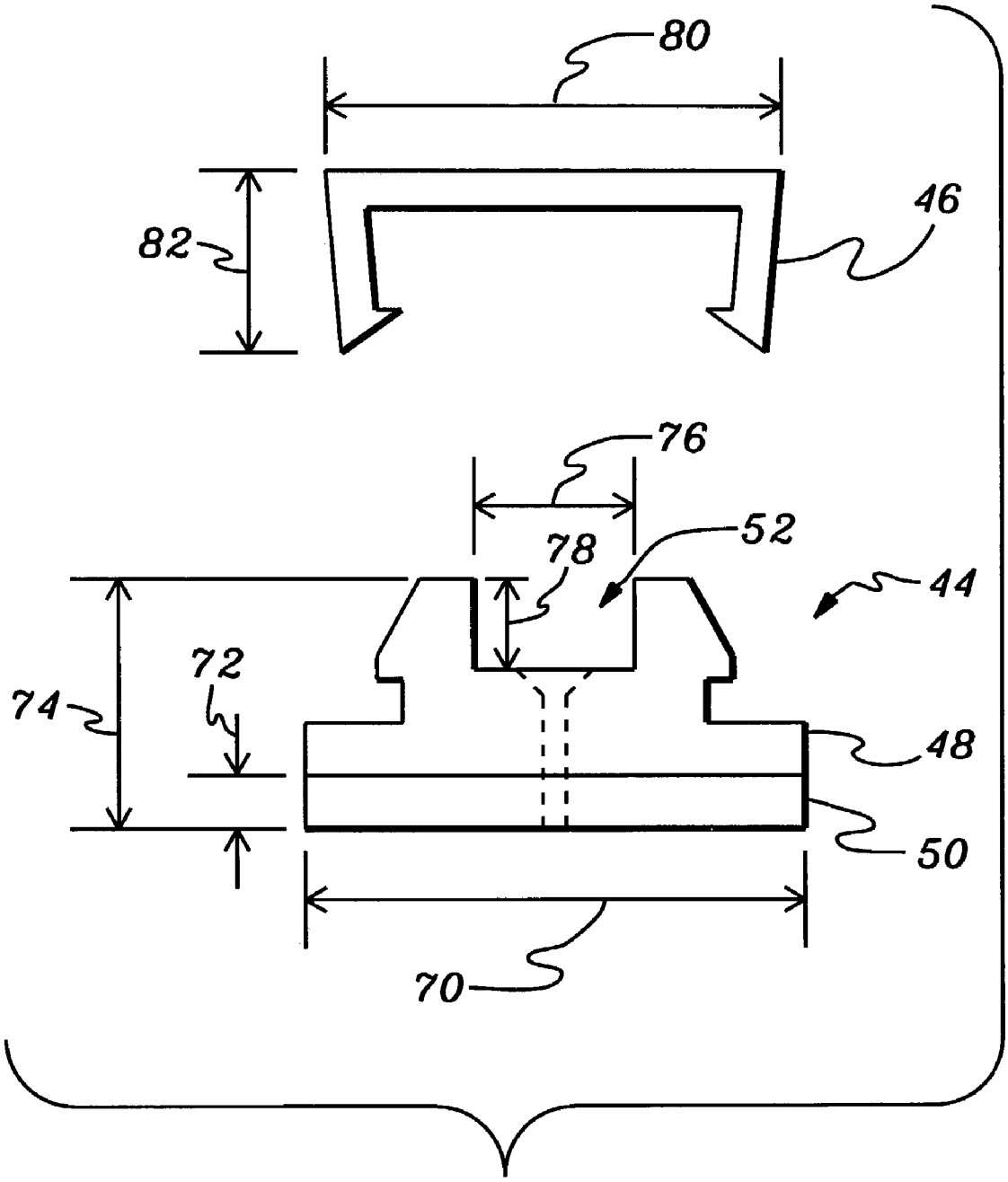
FIG. 8 illustrates an identical view as shown in FIG. 7 illustrating typical dimensions of one aspect of the present invention.

FIG. 8 illustrates an identical view as shown in FIG. 7, but illustrating typical dimensions of one aspect of the present invention. For example, in one aspect of the invention, the width 70 of mounting element 44 may range from about 0.25 inches to about 3 inches. In another aspect of the invention, width 70 may range from about 0.75 inches to about 1.50 inches; for example, width 70 may be between about 1.0 inches and about 1.20 inches. In one aspect of the invention, the thickness 72 of gasket 50 may range from about 0.03125 inches to about 1.0 inches. In another aspect of the invention, thickness 72 may range from about 0.0625 inches to about 0.75 inches; for example, thickness 72 may be between about 0.0625 inches to about 0.1875 inches. In one aspect of the invention, the height 74 of mounting element 44 may range from about 0.25 inches to about 2.0 inches. In another aspect of the invention, height 74 may range from about 0.50 inches to about 1.0 inches; for example, height 74 may be between about 0.5625 inches and about 0.625 inches. In one aspect of the invention, the width 76 of channel 52 may range from about 0.125 inches to about 2.0 inches. In another aspect of the invention, width 76 may range from about 0.25 inches and about 1.0 inches; for example, width 76 may be between about 0.3125 inches and about 0.4375 inches. In one aspect of the invention, the depth 78 of channel 52 may range from about 0.125 inches to about 1.50 inches. In another aspect of the invention, depth 78 may range from about 0.1875 inches to about 0.50 inches; for example, depth 78 may be between about 0.1875 inches and about 0.25 inches. In one aspect of the invention, the width 80 of cover 46 may range from about 0.25 inches to about 3.0 inches. In another aspect of the invention, width 80 may range from about 0.50 inches to about 1.50 inches; for example, width 80 may be between about 0.9375 inches and about 1.0 inches. In one aspect of the invention, the height 82 of cover 46 may range from about 0.25 inches to about 2.0 inches. In another aspect of the invention, height 82 may range from about 0.25 inches to about 1.0 inches; for example, height 82 may be between about 0.3125 inches and about 0.4375 inches.

Aspects of the present invention provide improved mounting elements, mounting arrangements, and methods of mounting liners to structures, such as stair assemblies, in pools and spas. The present invention facilitates the assembly of pools and spas by reducing the number of individual parts required and minimizing the potential for damaging the liner compared to prior art arrangements and methods while maintaining the desired function, that is, providing a liquid-tight interface. As will be appreciated by those skilled in the art, features, characteristics, and/or advantages of the mounting elements, mounting arrangements, and methods of mounting described herein, may be applied and/or extended to any embodiment (e.g., and/or portion thereof).

Although several aspects of the present invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

I claim:

1. A pool liner and mounting element adapted to retain at least a portion of the pool liner to a structure of a bathing enclosure, the mounting element comprising:

a top plate having a first side and a second side opposite the first side; and a gasket having a first side mounted directly to the second side of the top plate and a second side adapted to contact the pool liner and prevent contact between the top plate and the pool liner.

2. The mounting element as recited in claim 1, wherein the mounting element comprises a co-extrusion of the top plate and the gasket.

3. The mounting element as recited in claim 2, wherein co-extruding comprises one of hot co-extrusion and dual durometer co-extrusion.

4. The mounting element as recited in claim 2, wherein the top plate comprises a first material and the gasket comprises a second material, softer than the first material.

5. The mounting element as recited in claim 4, wherein the first material comprises a material having an Izod impact resistance of at least about 5.0 foot-pounds per inch and the second material comprises a material having a Shore A hardness of at most about 100.

6. The mounting element as recited in claim 1, wherein the mounting element further comprises a cover piece that mounts over the top plate.

7. The mounting element as recited in claim 1, wherein the structure comprises one of a step assembly, a ladder assembly, and a seat assembly.

8. The mounting element as recited in claim 1 wherein the top plate comprises an elongated top plate.

9. A mounting arrangement adapted to retain at least a portion of a pool liner to a structure of a bathing enclosure, the mounting arrangement comprising:

a gasketed mounting element comprising a top plate having a first side and a second side opposite the first side and a gasket having a first side mounted directly to the top plate and a second side adapted to contact the pool liner and prevent contact between the top plate and the pool liner; and means mounting the gasketed mounting element to the structure wherein the pool liner is secured to the structure.

10. The mounting arrangement as recited in claim 9, wherein the mounting arrangement is adapted to minimize puncturing of the liner by the top plate.

11. The mounting arrangement as recited in claim 9, wherein the gasketed mounting element comprises a co extrusion of the top plate and the gasket.

12. The mounting arrangement as recited in claim 11, wherein co-extruding comprises one of hot co-extrusion and dual durometer co-extrusion.

13. The mounting arrangement as recited in claim 11, wherein the top plate comprises a first material and the gasket comprises a second material, softer than the first material.

14. The mounting arrangement as recited in claim 13, wherein the first material comprises a material having an Izod impact resistance of at least about 5.0 foot-pounds per inch and the second material comprises a material having a Shore A hardness of at most about 100.

15. The mounting arrangement as recited in claim 9, wherein the means for mounting comprises a backing member positioned behind the structure and means for attaching the gasketed mounting element to the backing member.

16. The mounting arrangement as recited in claim 15, wherein the means for attaching the gasketed mounting element to the backing member comprises at least one mechanical fastener.

17. The mounting arrangement as recited in claim 16, wherein the gasketed mounting element further comprises at least one through hole for accepting the at least one mechanical fastener.

18. The mounting arrangement as recited in claim 9, wherein the gasketed mounting element comprises an elongated gasketed mounting element.

19. The mounting arrangement as recited in claim 9, wherein the mounting arrangement further comprises a cover which mounts to the gasketed mounting element.

20. The mounting arrangement as recited in claim 9, wherein the structure comprises one of a stair assembly, a ladder assembly, and a seat assembly.

* * * * *

UNITED STATES PATENT AND TRADEMARK OFFICE

CERTIFICATE OF CORRECTION

PATENT NO. : 7,040,060 B2
APPLICATION NO. : 10/350824
DATED : May 9, 2006
INVENTOR(S) : Wesley O. Cox It is certified that error appears in the above-identified patent and that said Letters Patent is hereby corrected as shown below:

Claims:

Claim 9

Col. 8, line 21, insert the word --for-- after the word "means"

Signed and Sealed this

Eleventh Day of July, 2006

JON W. DUDAS
*Director of the United States Patent and Trademark Office*